US005259514A

United States Patent [19]

Falter et al.

[11] Patent Number: 5,259,514

[45] Date of Patent: Nov. 9, 1993

[54] APPARATUS FOR THE SEPARATE DUMPING OR SORTING OF DIFFERENT MATERIALS, ESPECIALLY HOUSEHOLD GARBAGE

[76] Inventors: Rita Falter, Hadorfer Strasse 7, D-8130 Starnberg; Hartmut E. Fehr, Happergerstrasse 20, D-8196 Eurasburg, both of Fed. Rep. of Germany

[21] Appl. No.: 779,731

[22] Filed: Oct. 23, 1991

[30] Foreign Application Priority Data

Oct. 24, 1990 [DE] Fed. Rep. of Germany ..... 9014722

[51] Int. Cl.[5] ..... B07C 7/04

[52] U.S. Cl. ..... 209/702; 209/930; 220/909

[58] Field of Search ..... 209/702, 930; 220/908, 220/909, 910; 211/10

[56] References Cited

U.S. PATENT DOCUMENTS

| | | | |
|---|---|---|---|
| 4,660,758 | 4/1987 | Tavel et al. | 209/930 X |
| 4,682,699 | 7/1987 | Ertley | 211/71 |
| 4,960,220 | 10/1990 | Foa | 220/909 X |
| 4,974,746 | 12/1990 | Dickinson | 209/702 X |
| 5,000,325 | 3/1991 | D'Elia | 209/702 |
| 5,090,587 | 2/1992 | Brown | 220/909 X |
| 5,096,086 | 3/1992 | Crema | 220/909 X |

FOREIGN PATENT DOCUMENTS

| | | | |
|---|---|---|---|
| 0092164 | 10/1983 | European Pat. Off. | 209/702 |
| 8511777 | 7/1985 | Fed. Rep. of Germany . | |
| 3403824 | 8/1985 | Fed. Rep. of Germany | 220/909 |
| 8634814 | 4/1987 | Fed. Rep. of Germany . | |
| 3625995 | 2/1988 | Fed. Rep. of Germany | 220/909 |
| 3630336 | 4/1988 | Fed. Rep. of Germany | 220/909 |
| 0539483 | 9/1941 | United Kingdom | 220/909 |
| 0601885 | 5/1948 | United Kingdom | 209/702 |

*Primary Examiner*—James R. Bidwell
*Attorney, Agent, or Firm*—Cushman, Darby & Cushman

[57] ABSTRACT

For the separate dumping or sorting of different materials, especially household garbage, a plurality of containers of complementary shaping is provided. The containers can be arranged to form a compact unit consisting of a plurality of containers. The containers have preferably triangular or trapezoidal base outline and in the side view, the containers are made substantially trapezoidal.

13 Claims, 7 Drawing Sheets

APPARATUS FOR THE SEPARATE DUMPING OR SORTING OF DIFFERENT MATERIALS, ESPECIALLY HOUSEHOLD GARBAGE

The invention relates to an apparatus for the separate dumping or sorting of different materials, especially of different materials contained in household garbage, such as plastic, glass, compostable material and the like.

For the separation of materials contained in waste, which is necessary for cost saving and for recycling, there is to be provided a simple and cost-effective apparatus, by means of which the sorting or separate dumping of different materials becomes easier and which can be arranged in a space-saving manner.

This is achieved, according to the invention, by means of a plurality of releasably interconnected containers which serve for receiving the different materials and which form a unit, each individual container being removable from the unit, in order to be emptied.

Advantageous embodiments of the invention are indicated in the following description and in the claims.

Figure 1A:
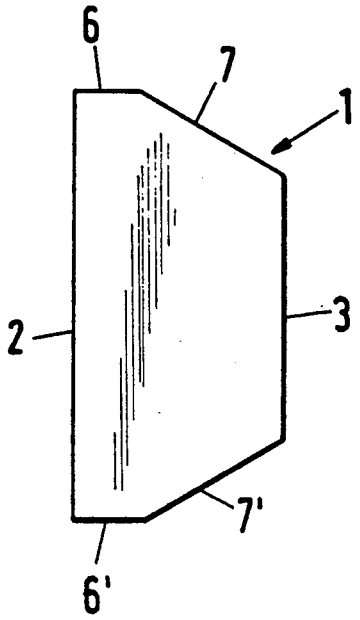
Figure 2A:
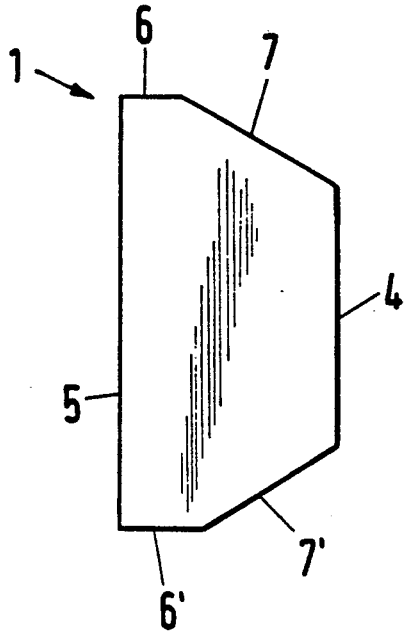
Figure 1B:
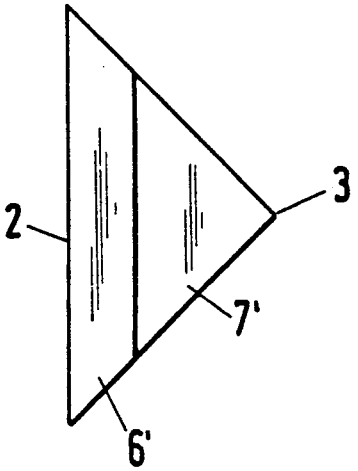
Figure 2B:
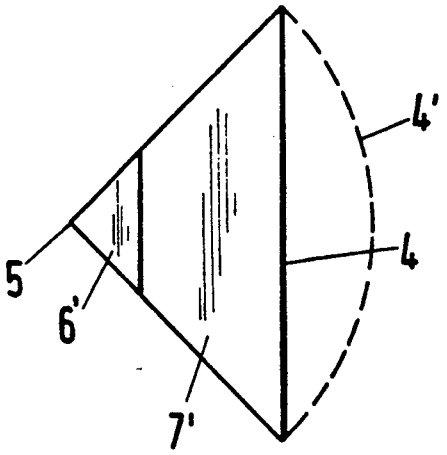
Figure 3A:
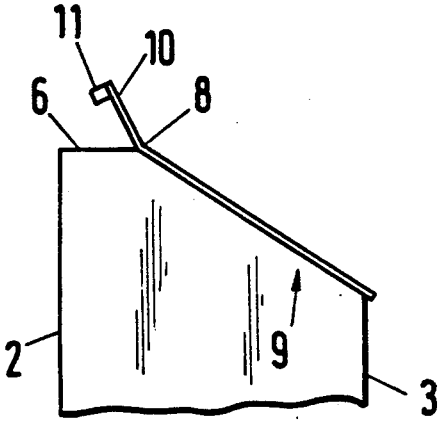
Figure 3C:
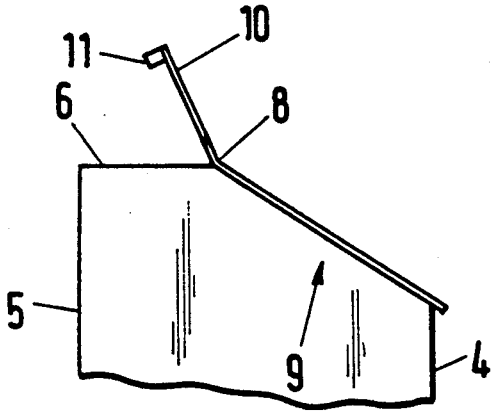
Figure 3B:
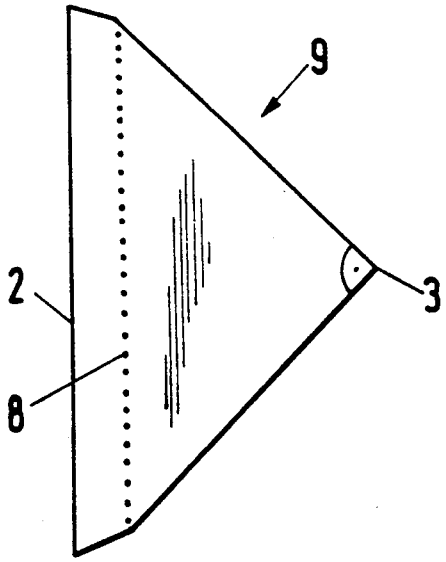
Figure 3D:
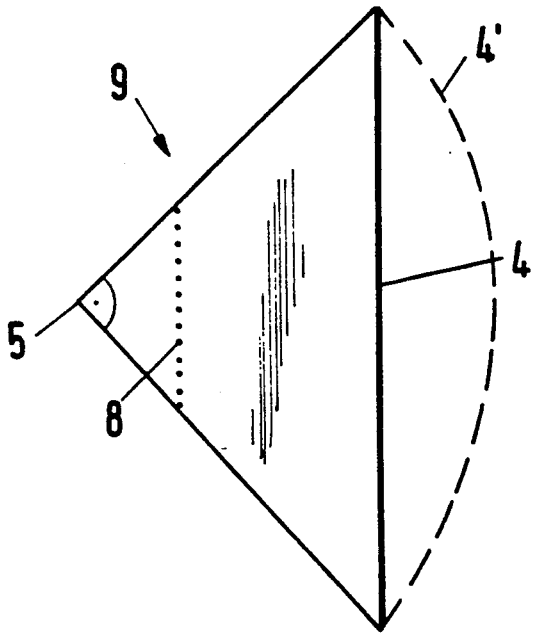
Figure 4:
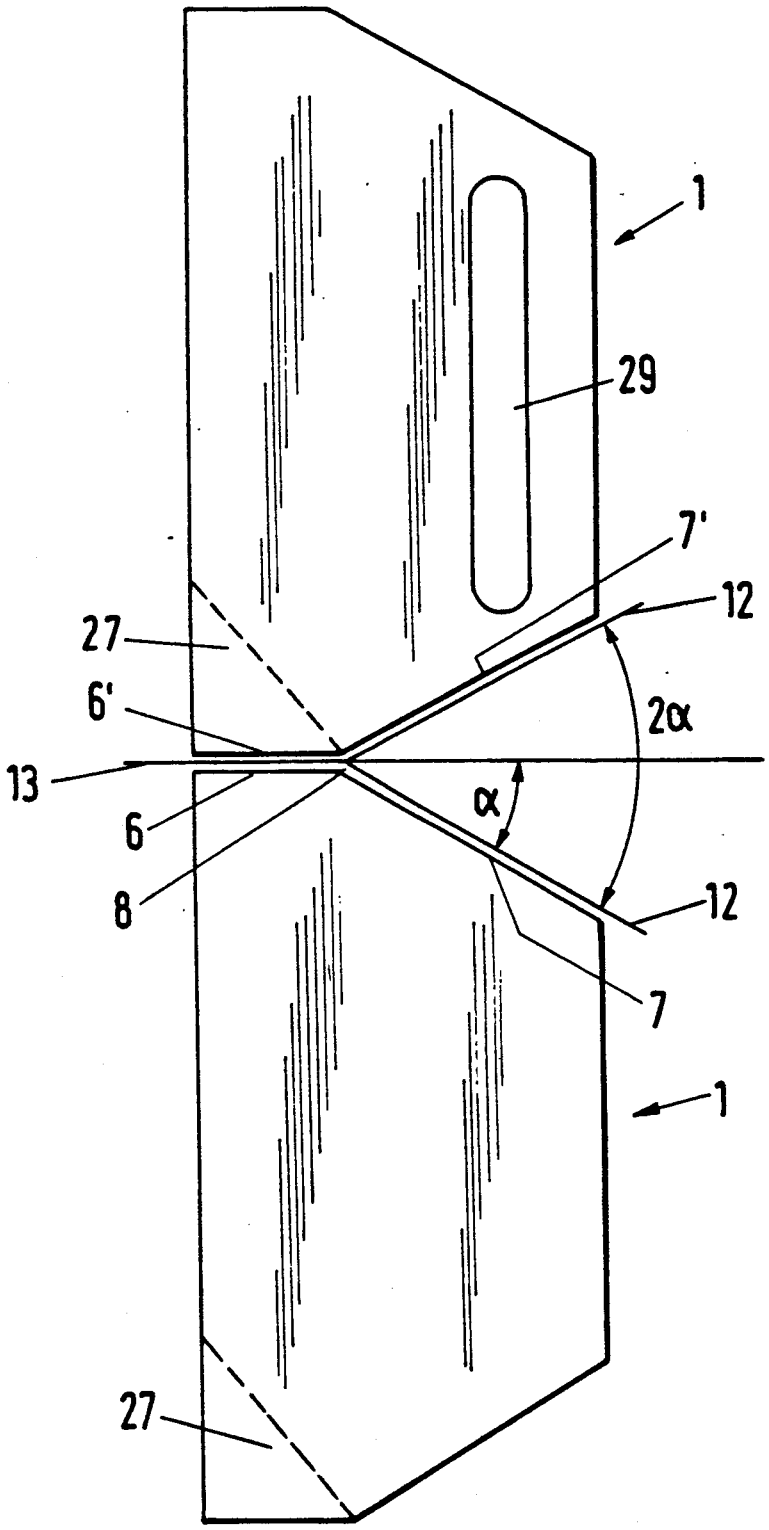
Figure 11:
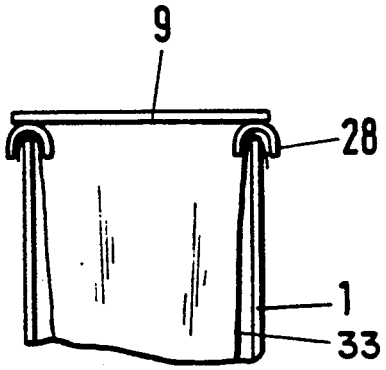
Figure 5:
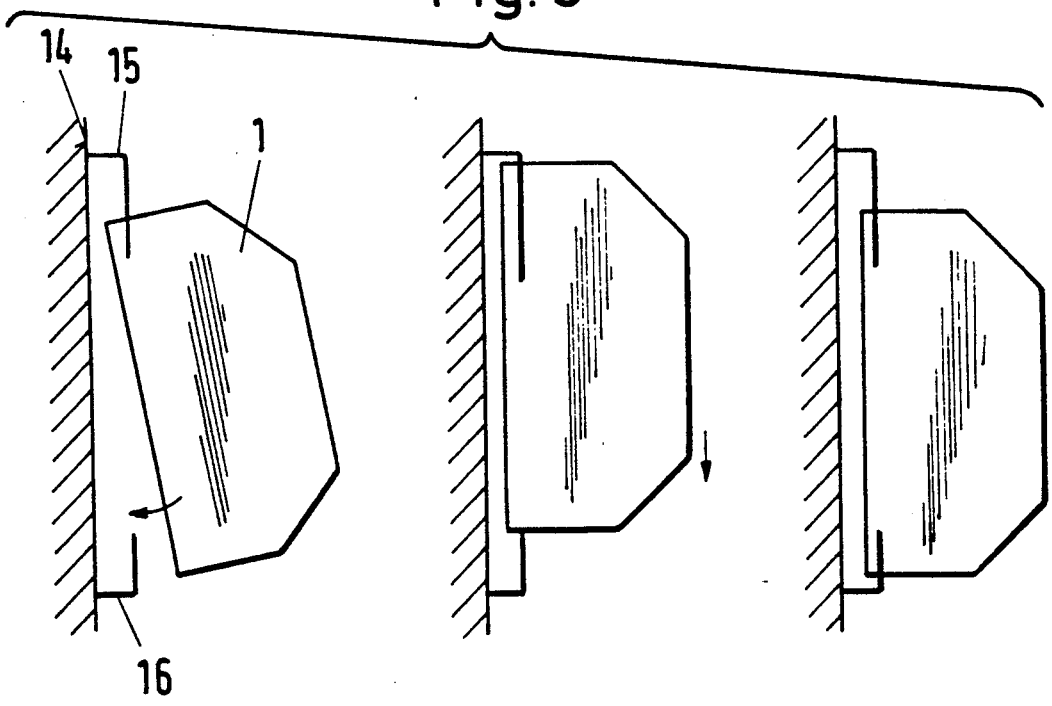
Figure 6:
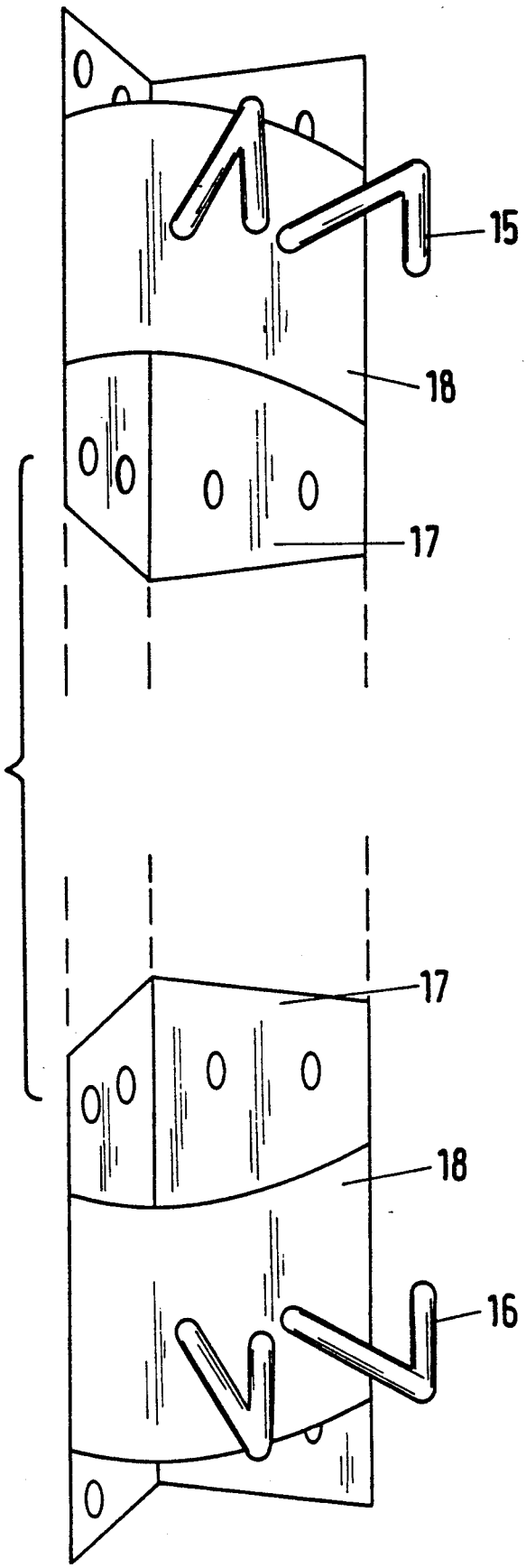
Figure 7:
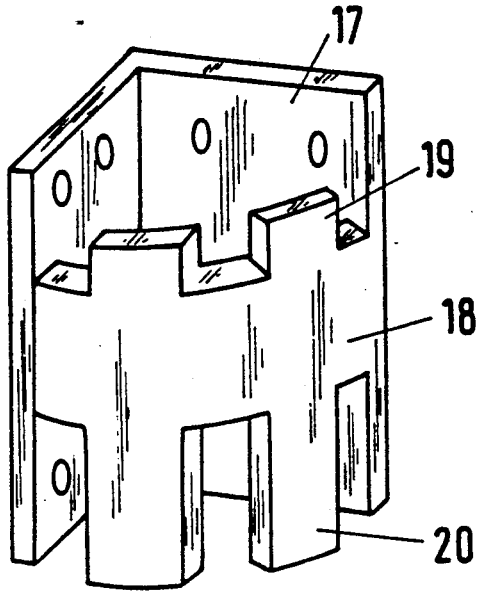
Figure 8A:
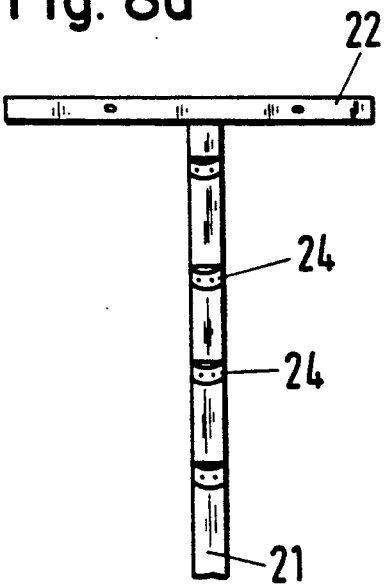
Figure 8B:
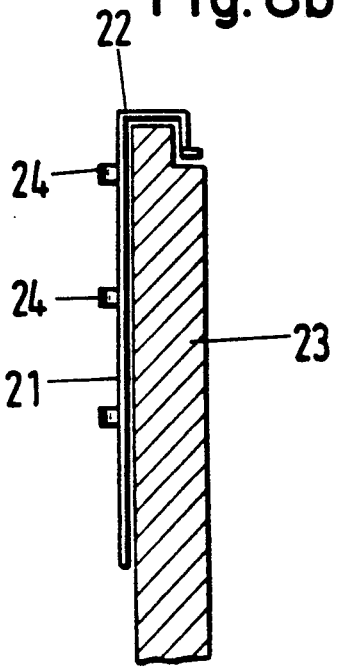
Figure 9A:
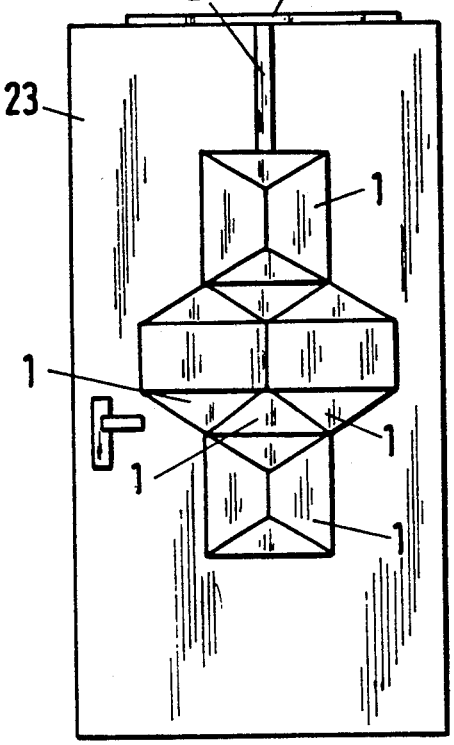
Figure 9B:
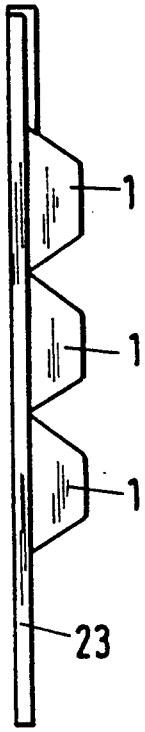
Figure 10A:
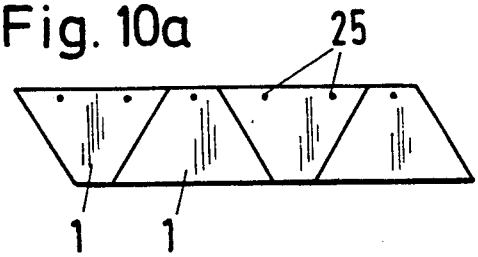
Figure 10B:
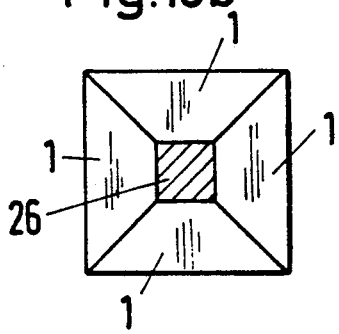
Figure 12A:
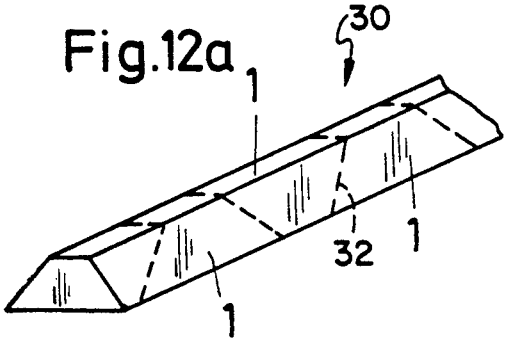
Figure 12B:
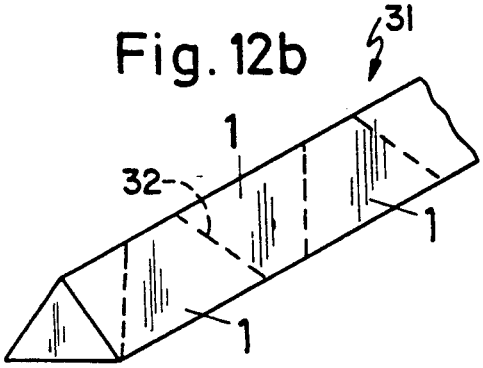

Exemplary embodiments of the invention are explained in more detail below by means of the drawings. In these:

FIGS. 1*a*–1*b* show a side view and cross-section of a container respectively, FIGS. 2*a*–2*b* show the same representation of an embodiment of modified base outline form, FIGS. 3*a*–3*d* show diagrammatic representations of a lid arrangement for the containers according to FIGS. 1*a*–1*b* and 2*a*–2*b* , FIG. 4 shows a side view of containers arranged one above the other, FIG. 5 shows diagrammatically a suspension device, FIG. 6 shows a perspective representation of a suspension device intended for mounting in a corner, FIG. 7 shows a modified embodiment of such a suspension device, FIGS. 8*a*–8*b* show a diagrammatic representations of the mounting of the suspension device on a door leaf, FIGS. 9*a*–9*b* show views of a possible arrangement of a plurality of containers on a door leaf, FIGS. 10*a*–10*b* show a top views of two arrangements of containers of modified base outline form, FIG. 11 shows a cross-section through a holding device for an inner bag, and FIGS. 12*a*–12*b* show illustrations of the production of the containers.

FIG. 1*a* shows a side view of a container 1 composed, in this view, of a rectangle and a trapezium and having a base outline (FIG. 1*b*) in the form of a right-angled triangle, the rear side being designated by 2 and the tapering front side by 3. In the embodiment according to FIG. 2*a*, the container 1 has the same form in side view, but the base outline (FIG. 2*b*), is designed so that the wide side face 4 is at the front and the rear side tapers at 5. In the side view, the containers according to FIGS. 1 and 2 have straight portions 6, 6' which extend from the rear side 2 or 5 and which adjoin portions 7, 7' converging obliquely forwards. The containers are open on the top side at the portions 6 and 7 or are equipped with a lid, whilst the portions 6', 7' form the bottom of the container.

In FIG. 2*b*, a curved or part-circular front wall of the container is represented by broken lines at 4'. But it is also possible to provide a polygonal base outline form.

The containers according to FIGS. 1 and 2 preferably consist of plastic, especially of material reprocessed by recycling. However, they can also consist of wood or metal or of another suitable material. By a complementary shaping in cross-section or in base outline, the containers can be placed laterally next to one another in various ways to form a unit.

FIGS. 3*a* and 3*c* show a side view, and FIGS. 3*c* and 3*d* show a top view of a lid 9 for the containers according to FIGS. 1*a* 1*b* and FIGS. 2*a*–2*b*, dotted line at 8 indicating the bending point between the portions 6 and 7, which at the same time forms the axis of articulation for the lid 9 articulated on the container. In the embodiment of FIGS. 3*a*–3*b*, the axis of articulation 8 is at a distance of approximately 1/5 to ¼ of the total depth of the lid from the rear side 2, whereas, in the embodiment of FIGS. 3*c*–3*d* the axis of articulation 8 is at a distance of approximately ⅔ of the lid depth from the front side 4. In the embodiment of the container equipped with a curved front wall 4', the lid 9 has a corresponding form.

As shown in FIGS. 3*a* and 3*c*, the lid 9 projects somewhat beyond the front side 3 or 4 in the closed position, so that it can easily be lifted with a finger. The upwardly angled portion 10 of the lid 9, which, in the closed position according to FIGS. 3*a* and 3*c*, projects upwards from the approximately horizontal portion 6 of the container and also in relation to the plane of the lid, forms a stop on the portion 6 of the container when the lid 9 is opened, so that the angle between the portion 6 of the container and the portion 10 of the lid corresponds to the opening angle of the lid.

The lid 9 equipped with a plane closing portion in FIGS. 3*a*–3*d* can also be made curved on the closing portion or be equipped with a grip batten.

FIGS. 3*a* and 3*c* indicates diagrammatically at 11 a counterweight which acts in relation to the closing portion and which, at a predetermined opening angle of the lid 9, holds this in the position of equilibrium or, at a larger opening angle, causes the lid to be held in the open position because the lever arm of the counterweight 11 generates in relation to the axis of articulation 8 a higher torque than the center of gravity of the closing portion of the lid 9 in relation to the axis of articulation 8. In the region of the closed position, the torque exerted by the closing portion in the direction of the closed position or downwards predominates. The counterweight 11 can also be formed by the shaping of the lid itself.

FIG. 4 shows diagrammatically containers 1 arranged one above the other, the portions 6, 6' being located close to one another. In this arrangement, a lid 12 articulated at 8 can be designed as a simple plate which covers the beveled portion 7 of the container 1, whilst the portion 6 can remain open. The angle $\alpha$ of the bevel of the portion 7 in relation to an axis of symmetry 13 amounts appropriately to 30°–45°, so that, in conjunction with the upwardly beveled bottom portion 7' of the container located above, a total opening angle of approximately 60° to 95° is obtained.

The angle of the bevel of the portion 7' or a limitation of the opening angle of the lid can be utilized for presorting, in that only items of predetermined size can be thrown into the container.

If lids according to FIG. 3 are provided in the arrangement according to FIG. 4, there is in the container bottom a cavity, as indicated at 27, into which the portion 10 of the lid 9 can engage in the closed position.

FIG. 5 shows diagrammatically a suspension device for a container 1, there being mounted on a wall or a plate or batten 14 hooks 15, 16 which are angled towards one another, the upper hook 15 having a longer holding portion than the lower hook 16, so that the container 1 can first be pushed in with the top side under the upper hook 15, whereupon the underside of the container is suspended on the lower hook 16, as indicated by an arrow in FIG. 5. In the engaged position, the longer holding portion of the upper hook 15 holds the container essentially up against the wall 14. Appropriate recesses or depressions, into which the hooks 15, 16 can engage, can be provided on the top side and underside of the container or else in the region of the rear side of the container. The spacing between the mutually opposite hooks is smaller than the container height.

FIG. 6 shows angle elements 17 which are arranged one above the other and can also be designed as a continuous angle batten and which are provided with bores for fastening, for example by means of screws. The free edges of the two legs of these elements 17 are connected to one another by means of a forwardly curved portion 18, to the front side of which are fastened hooks 15 and 16 for suspending a container.

Suspension elements of this type can also extend over a larger angular sector than 90°, for example over 180° or even 360°, in the lattern case such a suspension element having to be mounted, for example, on a column, as shown in FIG. 10*b*.

FIG. 7 shows a modified embodiment of such a suspension element 17, on the curved connecting portion 18 of which are formed in its plane upwardly and downwardly projecting holding portions 19 and 20. The lower holding portions 20 correspond to the longer holding portions of the upper hooks 15, whilst the shorter holding portions 19 correspond to the shorter holding portions on the hooks 16. The suspension element 17 according to FIG. 7 can thus be used simultaneously for the mounting of two containers arranged one above the other.

FIGS. 8*a* and 8*b* show diagrammatically a transverse holding batten 22 which is angled for suspension on a door leaf 23. Attached to this batten 22 is a downwardly extending batten 21 with suspension elements 24 for containers above one another and, if appropriate, also next to one another. The batten 24 can be made telescopic.

Such a suspension device can be provided especially on a kitchen door, so that different constituents of household garbage can be dumped separately in the containers. The individual containers can be removed separately from the suspension device in order to be emptied.

FIGS. 9*a*–9*b* show diagrammatically a front view and a side view of an arrangement of three containers 1 which are arranged next to one another and engage into one another and which have trapezoidal side faces, an individual container being suspended on a suspension device according to FIGS. 8*a*–8*b* respectively above and below this horizontal row of containers.

However, the apparatus described is not restricted only to household use, but it can also be employed in the industrial sector, with the containers made correspondingly larger, in which case there can be for the automatic opening of the lid of a container, for example, a light barrier or another sensor which, when a hand approaches, triggers the opening of the lid via an electrical or mechanical drive device. The container arrangement can also be employed in the public sector, for example at bus stops and the like, for example by the arrangement of a plurality of containers next to one another around a column. There can also be a locking system which allows individual containers or elements of the apparatus to be removed only by authorized persons.

Bags consisting of a plastic foil or paper can be inserted into the containers and are disposed of together with the content, so that there is no need to unhook a container in order to empty it. Projections or the like for suspending the free edge of an inner bag can be formed on the edge of the receiving orifice of a container. It is also possible to attach onto the upper edge of the container 1 a removable holder or frame 28, by means of which a bag 313 inserted into the container can be clamped tight, and the frame 28 can be equipped with an articulated lid 9, as shown diagrammatically in FIG. 11.

The connection between the individual containers to form a unit can be made in various ways, for example by interlinking by means of interlinking elements, such as clips or such like connecting elements, by a plug-and-socket system or else by screwing. The containers can be mounted directly on a wall, a door leaf, a cupboard side or the like, or a separate stand can be provided for the containers.

The containers can also have a shaping different from that described, for example a base outline in the form of a sector of a circle or a polygonal base outline. Preferably, the containers have an approximately triangular or trapezoidal base outline, so that they can be arranged respectively offset next to one another to form an approximately straight row or next to one another in the same direction to form a circle, as shown in FIGS. 10*a*–10*b* which illustrate containers 1 of trapezoidal base outline which can be suspended next to one another on a suitable suspension device, as indicated at 25, (FIG. 10*a*) or on a column 26 or be mounted releasably in another way (FIG. 10*b*).

The side walls of the containers are preferably so inclined obliquely relative to the vertical that the containers can be stacked compactly in one another. Recesses or hook elements for suspension can be formed on the side walls of the container.

Insofar as a lid is provided on a container, this is appropriately articulated by means of a catch device. It is also possible to attach an articulated mounting of the lid onto the container. Depending on the intended use of the containers, there can be a device by means of which the lids of a plurality of containers can be opened simultaneously, for example by the actuation of a pedal. For this, there can also be another drive device which works in conjunction with a sensor.

An elongate inspection window is shown at 29 in FIG. 4.

FIGS. 12*a*–12*b* show a perspective views of two hollow sections 30 and 31 which are produced from plastic, for example by extrusion, and have a trapezoidal and triangular cross-section and from which complementary containers 1 can be cut without loss of material, as indicated at 32 by broken lines. The bottom can be attached to a container 1, cut off in this way, by means of a plug-and-socket connection or by welding. The lid can be articulated on the rear edge of the respective container or at a distance from the rear edge, as represented in FIGS. 3*a*–3*d* by the axis of articulation 8.

We claim:

1. An apparatus for separately receiving and sorting a plurality of waste materials for separate disposal of each said waste material, the apparatus comprising:

a plurality of containers of complementary shaping adapted to be arranged to form a single, compact unit, each said container of said plurality of containers being substantially trapezoidal with an inclined top portion and inclined bottom portion converging forwardly, when viewed from a side thereof, wherein said plurality of containers includes at least first and second containers being vertically stacked so as to form said single compact unit, said first container being disposed above said second container, said inclined top portion of each said first and second containers including a lid, said inclined bottom portion of said first container and said inclined top portion of said second container defining a gap permitting the lid of said second container to be accessed and opened.

2. The apparatus as claimed in claim 1, wherein each said container has one of a triangular and trapezoidal base.

3. The apparatus as claimed in claim 1, wherein each said container has a base shaped as a sector of a circle.

4. The apparatus as claimed in claim 1, wherein said lid may be opened without being completely removed from said top portion.

5. The apparatus as claimed in claim 1, further comprising a mounting structure for removably mounting said plurality of containers to a vertical surface.

6. The apparatus as claimed in claim 5, wherein said mounting structure includes mutually opposite hooks.

7. The apparatus as claimed in claim 5, wherein said mounting structure includes a mounting bracket adapted to be suspended from a door, said mounting bracket including suspension elements for removably mounting said containers.

8. The apparatus as claimed in claim 1, further comprising a holder of substantially U-shaped cross-section adapted to receive a disposable bag within each said container.

9. An apparatus for separately receiving and sorting a plurality of waste materials for separate disposal of each said waste material, the apparatus comprising:

a plurality of containers of complementary shaping adapted to be arranged to form a single, compact unit, each said container of said plurality of containers being substantially rectangular with an inclined top portion and inclined bottom portion converging forwardly, when viewed from a side thereof, a top of each said container including said inclined top portion and a flat portion when viewed from the side thereof, an openable lid being coupled to said top so as to cover said inclined portion, said lid including a pivot disposed at a point where said flat portion meets said inclined portion, a portion of said lid being disposed above said flat portion at an angle so as to define a stop for said openable lid.

10. The apparatus as claimed in claim 9, wherein each said container has one of a triangular and trapezoidal base.

11. The apparatus as claimed in claim 9, wherein each said container has a base shaped as a sector of a circle.

12. The apparatus as claimed in claim 9, wherein said lid may be opened without being completely removed from said top portion.

13. The apparatus as claimed in claim 9, wherein said plurality of containers includes at least first and second containers being vertically stacked so as to form said single compact unit, said first container being disposed above said second container, each said container including a cavity in a bottom portion thereof for receiving said angled lid portion defining said stop.

* * * * *